United States Patent [19]

Kawamura

[11] Patent Number: 5,009,389

[45] Date of Patent: Apr. 23, 1991

[54] ELECTROMAGNETIC FORCE VALVE DRIVING APPARATUS

[75] Inventor: Hideo Kawamura, Samukawa, Japan

[73] Assignee: Isuzu Ceramics Research Institute, Co., Ltd., Fujisawa, Japan

[21] Appl. No.: 480,578

[22] Filed: Feb. 15, 1990

[30] Foreign Application Priority Data

Feb. 20, 1989 [JP] Japan ..... 1-038429

[51] Int. Cl.[5] ..... F16K 31/06

[52] U.S. Cl. ..... 251/129.1; 251/129.05; 123/90.11

[58] Field of Search ..... 123/90.11; 251/129.1, 251/129.05

[56] References Cited

U.S. PATENT DOCUMENTS 4,350,319 9/1982 Kawata et al. ..... 251/129.21 X 4,726,389 2/1988 Minoura et al. ..... 251/129.05 X 4,794,890 1/1989 Richeson, Jr. ..... 123/90.11

*Primary Examiner*—Arnold Rosenthal

*Attorney, Agent, or Firm*—Staas & Halsey

[57] ABSTRACT

An valve driving apparatus includes a freely reciprocatable movable magnetic pole connected to a suction/exhaust valve, a fixed magnetic pole opposing one end of the movable magnetic pole, and a spring biasing the suction/exhaust valve in the closing direction at all times. When the suction/exhaust valve is released, the one end of the movable magnetic pole and the fixed magnetic pole are energized to have the same polarity and the suction/exhaust valve is driven in the opening direction by a repulsive force acting between the two magnetic poles. The suction/exhaust valve is held at a position where the repulsive force and spring force balance each other. The suction/exhaust valve is caused to begin moving in the closing direction by eliminating the repulsive force. The two magnetic poles are excited again immediately before the valve is seated, thereby reducing the traveling speed in the closing direction to mitigate seating shock.

5 Claims, 3 Drawing Sheets

ELECTROMAGNETIC FORCE VALVE DRIVING APPARATUS

BACKGROUND OF THE INVENTION

1. FIELD OF THE INVENTION

This invention relates to an electromagnetic force valve driving apparatus for opening and closing the suction/exhaust valve of an engine by an electromagnetic force produced by an electromagnet.

2. DESCRIPTION OF THE PRIOR ART

In one example of a conventional drive apparatus for opening and closing a suction/exhaust valve, a cam shaft on which cams for suction and exhaust are disposed is provided on the upper portion of the engine or on one side face thereof. A crankshaft, which is the rotary shaft of the engine, and the cam shaft are connected by rotary transmission means such as a belt, and the cam shaft is driven rotatively in synchronism with the rotational phase of the engine.

The cam face of the cam shaft and the axial end face of the valve are connected via a link mechanism such as a rocker arm or pushing rod. The suction/exhaust valve, which is biased in the closing direction at all times by a valve spring, is driven in the opening direction by the link mechanism which acts to push the axial end face of the valve.

This conventional drive apparatus for opening and closing the suction/exhaust valve results in a large-size engine because the cam shaft and link mechanism must be added to the engine.

Furthermore, since the cam shaft and link mechanism are driven by the output shaft of the engine, some of the engine output is consumed by frictional resistance when the cam shaft and link mechanism are driven. This diminishes the effective output of the engine.

Further, the actuation timing of the suction/discharge valve cannot be altered during engine operation. Since the valve actuation timing is adjusted in conformity with the rotational speed of the engine, engine and output and efficiency decline when the engine is running at an rpm different from the prescribed rpm.

In order to solve the foregoing problems, an apparatus for driving a suction/exhaust valve by an attractive force acting between a movable magnetic pole connected to the suction/exhaust valve and a magnetic pole of a fixed electromagnet has been disclosed in Japanese Patent Application Laid-Open (KOKAI) Nos. 58-183805 and 61-76713.

In this apparatus, the distance between the magnetic pole of the electromagnet and the movable magnetic pole is maximum at the moment the attractive force starts acting upon the movable magnetic pole. Consequently, the attractive force between the magnetic pole of the electromagnet and the movable magnetic pole is minimum at this time. Accordingly, acceleration of the movable magnetic pole immediately after it starts moving is low, and therefore the size of the opening of the valve operatively associated with the movable magnetic pole is small.

Further, since the distance between the electromagnet and the movable magnetic pole is large even in a case where a braking force is applied to the movable magnetic pole just prior to valve seating in order to mitigate shock when the valve is seated, as described in the specification of Japanese Patent Application Laid-Open No. 61-76713, the braking force is too small to reduce the seating shock sufficiently.

SUMMARY OF THE INVENTION

The present invention has been devised in view of the foregoing points and its object is to provide an electromagnetic force valve driving apparatus in which the magnetic force that acts upon the valve is maximized when the valve starts moving and when the valve is seated.

According to the present invention, the foregoing object is attained by providing an electromagnetic force valve driving apparatus comprising a freely reciprocatable movable magnetic pole connected to a suction/exhaust valve, an upper fixed magnetic pole opposing one end of the movable magnetic pole, a first electromagnet comprising a yoke member communicating with the upper fixed magnetic pole and having a lower magnetic pole opposing the other end of the movable magnetic pole, a second electromagnet having a magnetic pole opposing the upper magnetic pole and the one end of the movable magnetic pole, a spring for subjecting the movable magnetic pole to a force which moves the pole in the direction of the one end thereof, and energizing control means for energizing the first and second electromagnets when the suction/exhaust valve is released and immediately before it is seated, thereby causing a repulsive force to act between the one end of the movable magnetic pole and the upper fixed magnetic pole.

With the electromagnetic force valve driving apparatus of the present invention, a repulsive force is caused to act between the one end of the movable magnetic pole and the upper fixed magnetic pole when the suction/exhaust valve is released. The repulsive force drives the suction/exhaust valve in the opening direction. After the movable magnetic pole has been held for a prescribed period of time at a position where the repulsive force and spring force are in balance, energization is terminated so that the suction/exhaust valve is closed by the force of the spring.

Energization is resumed for a prescribed period of time just prior to seating of the valve, thereby decelerating the valve in the closing direction to mitigate seating shock.

Thus, in accordance with the present invention, there can be provided an electromagnetic force valve driving apparatus for high output and superlative fuel economy in which driving of the suction/exhaust valve in the opening direction and braking of the valve at seating are achieved by an electromagnetic force, and a large amount of drive in the opening direction as well as a large acceleration at seating is obtained. As a result, the degree to which the suction/exhaust valve opens is enlarged, i.e., the suction/exhaust resistance is diminished.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

An embodiment of the present invention will now be described in detail in accordance with the drawings.

Figure 1:
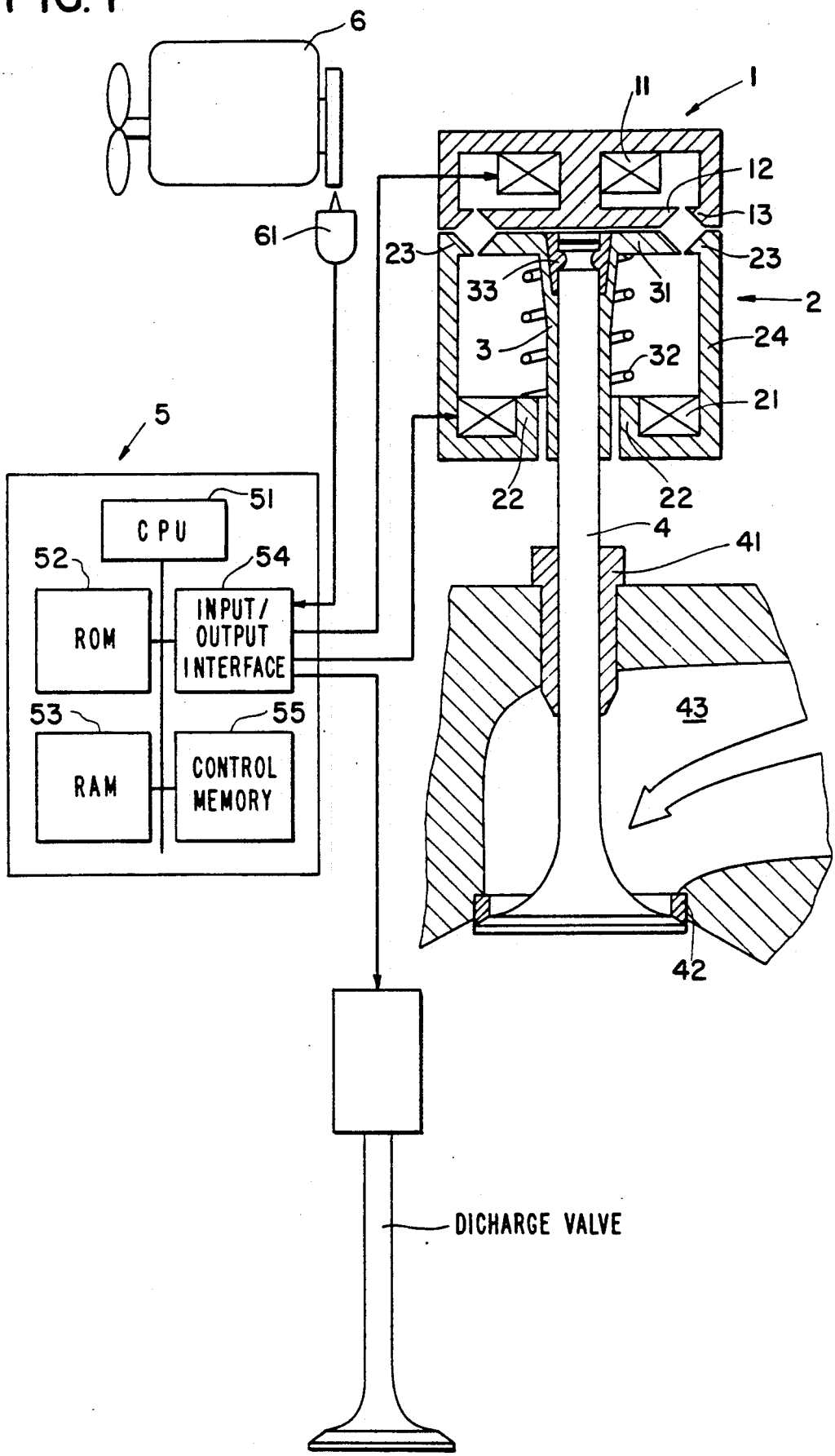
FIG. 1 is a block diagram illustrating an embodiment of the present invention.

FIG. 1 is a block diagram illustrating the drive apparatus of the present invention.

An engine 6 has a suction valve for opening and closing the suction port of a cylinder, and a discharge valve for opening and closing the discharge port of the cylinder. The discussion that follows will deal primarily with the suction valve.

Numeral 4 denotes the suction valve, which is formed of a heat-resistant, light-weight ceramic. It is also permissible to form the suction valve 4 of a heat-resistant alloy, as in the prior art.

The suction valve 4 is axially supported by a valve guide 41 so as to freely slidable in the axial direction and has a bevel-shaped portion which is seated on a valve seat 42 disposed at the outlet of an intake conduit 43, thereby closing the suction port. A movable magnetic pole member 3 comprising a magnetic material is fixedly secured to the axial end portion of the suction valve 4 by a fixing member 33.

The axial end portion of the movable magnetic pole member 3 is formed to have a radially projecting end magnetic pole 31. An upper electromagnet 1 is disposed in close proximity to the end magnetic pole 31 on the upper side thereof and comprises a central magnetic pole 12 opposing the end magnetic pole 31, a peripheral magnetic pole 13 opposing the central magnetic pole 12, and an upper coil 11 for producing magnetic lines of force in the central magnetic pole 12 and peripheral magnetic pole 13.

A lower electromagnet 2 is provided about the outer periphery of the movable magnetic pole member 3 and comprises an upper magnetic pole 23 opposing the peripheral magnetic pole 13 and the end magnetic pole 31 a lower magnetic pole 22 opposing the outer peripheral surface of the movable magnetic pole member 3, and a lower coil 21 for generating magnetic lines of force in the upper magnetic pole 23 and lower magnetic pole 22. The upper magnetic pole 23 and the lower magnetic pole 22 are magnetically in communication with each other through a yoke member 24.

A spring 32 for applying an upwardly directed force to the suction valve 4 via the movable magnetic pole member is disposed between the end magnetic pole 31 and the lower magnetic pole 22.

The upper coil 11 and the lower coil 21 are connected to an input/output interface 54 within a control unit 5. Connected to the input/output interface 54 in addition to the upper coil 11 and lower coil 21 is a rotary sensor 61 provided in close proximity to the output shaft of the engine 6.

The control unit 5 comprises, in addition to the input-/output interface 54 which supervises signal input/output with the external equipment, comprises a ROM 52 in which programs and data are stored in advance, a CPU 51 for performing processing under control of the programs stored in the ROM 52, a RAM 53 for temporarily storing input signals and the results of processing, and a control memory 55 for controlling the flow of signals within the control unit 5.

The operation of the apparatus according to the invention will now be described.

Figure 2:
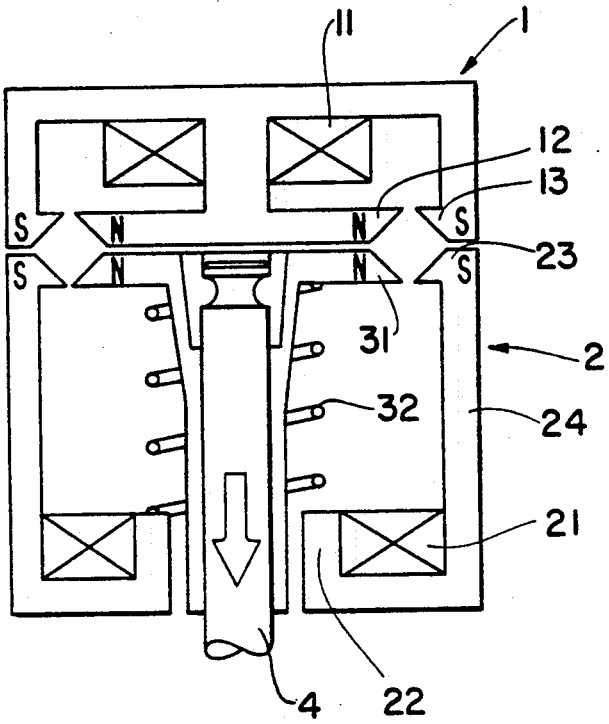
FIG. 2 is a view showing a valve drive section.
Figure 2:
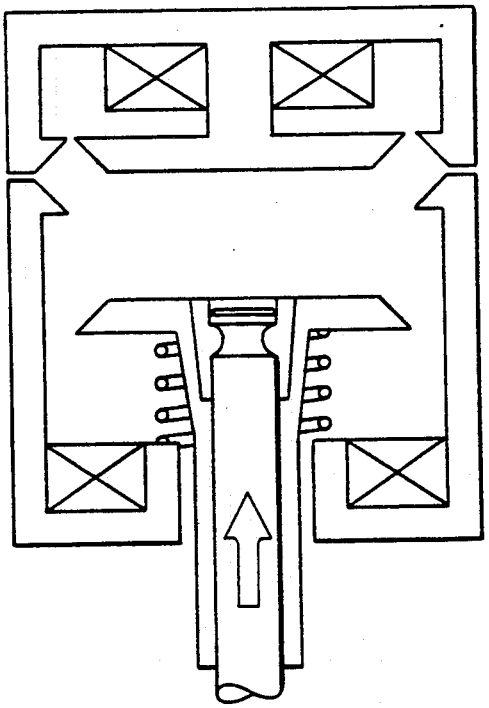

FIG. 2 is a view illustrating the upper electromagnet 1 and lower electromagnet 2, which constitute the valve drive section. The slanting lines indicating cross section in FIG. 1 are deleted from FIG. 2.

During ordinary operation, the suction valve 4 is urged upwardly by the spring 32 and held at a position where it is seated on the valve seat 42. When the rotational phase of the engine 6 sensed by the rotation sensor 61 represents the timing for opening the suction valve 4, a current is passed through the upper coil 11 in such a manner that an N pole is produced in the central magnetic pole 12 and an S pole in the peripheral magnetic pole 13. Concurrently, a current is passed through the lower coil 21 as well to produce an N pole in the lower magnetic pole 22 and an S pole in the upper magnetic pole 23.

Since the end magnetic pole 31 opposes the upper magnetic pole 23, an N pole is produced in the end magnetic pole 31 by the S pole generated in the upper magnetic pole 23. Accordingly, the central magnetic pole 12 and the end magnetic pole 31 are identical in polarity and repel each other, as a result of which the suction valve 4 is driven downwardly.

Since the distance between the central magnetic pole 12 and end magnetic pole 31 at the moment the foregoing driving operation begins is minimum in terms of the vertical stroke of the suction valve 4, the downwardly directed driving force produced by the electromagnetic repulsion is maximum.

When the suction valve 4 is thus driven downwardly to increase the distance between the end magnetic pole 31 and central magnetic pole 12, the repulsive force decreases and the upwardly directed force produced by the spring 32 increases. The suction valve 4 stops at a position where the downward repulsive force and the upward spring force balance each other.

Supply of current to the upper coil 11 and lower coil 21 is interrupted at passage of a first predetermined time period from the moment the suction valve 4 is opened. As a result, the downward repulsive force vanishes and only the upwardly directed force produced by the spring 32 remains. Accordingly, the suction valve 4 is driven upwardly. Immediately before the suction valve 4 is seated on the valve seat 42, namely at passage of a second predetermined time period clocked from the moment the first time period elapses, a current is again passed through the upper coil 11 and lower coil 21 in such a manner that N poles are produced in the central magnetic pole 12 and end magnetic pole 31. Owing to the supply of current, a downwardly directed repulsive force acts upon the suction valve 4 to reduce the velocity of its upward movement, thereby mitigating shock produced when the valve 4 is seated on the valve seat 42.

At passage of a third set time period set in advance as the time required for deceleration, supply of current to the upper coil 11 and lower coil 21 is interrupted again. As a result, the suction valve 4 is maintained in the seated position on the valve seat 42 by the spring 32.

A table giving the correlation between each set time period and engine rpm is stored in the ROM 52 beforehand. The first, second and third time periods mentioned above are obtained by calculating the set time corresponding to engine rpm from the rpm of the engine 6, which is sensed by the rotation sensor 61, and the correlation table.

The opening and closing of the valve will now be described with reference to FIG. 3.

Figure 3:
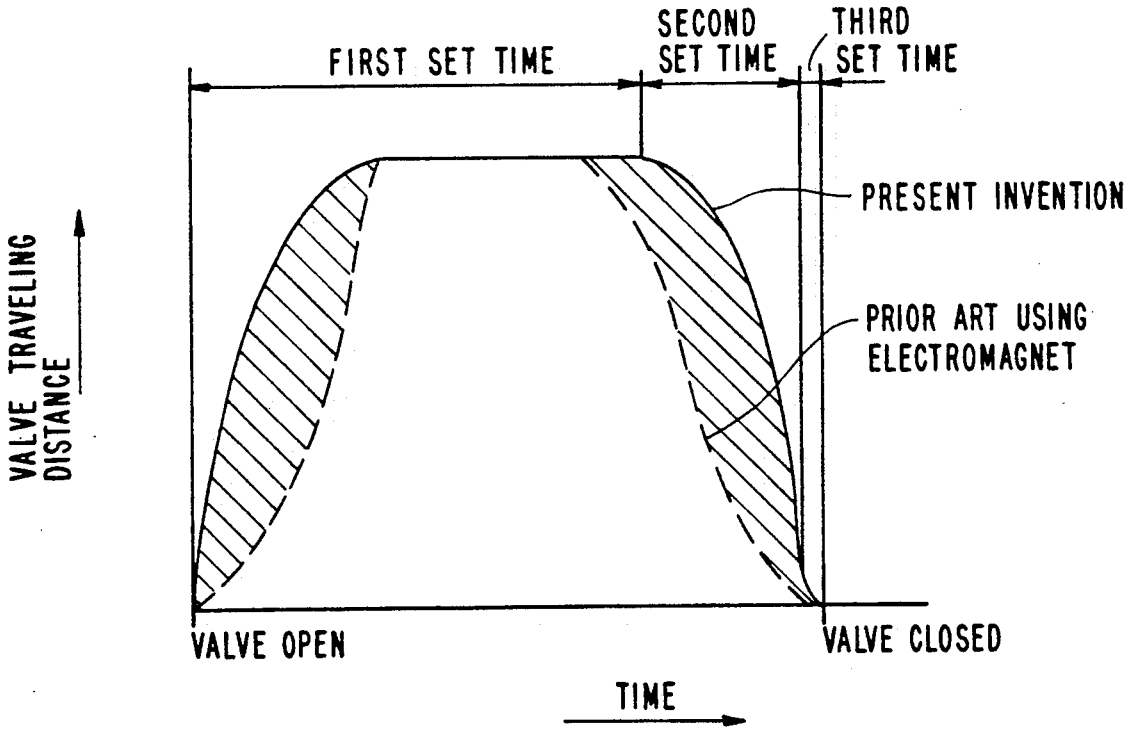
FIG. 3 is a diagram showing the relationship between amount of valve movement and time.

FIG. 3 shows so-called cam profile curves, in which the horizontal axis represents the opening timing of the suction valve 4, and the vertical axis represents the amount of valve movement. The curves in this diagram indicate the change in the amount of movement of the suction valve with the passage of time. The curve indicated by the solid line is that according to the present invention, while the curve indicated by the dashed line is that obtained with the conventional apparatus using electromagnets.

In the conventional apparatus associated with the curve indicated by the dashed line, the valve is driven by an attractive force produced electromagnetically. Consequently, the attractive force is minimum at the moment the force begins to act, and the distance over which the electromagnetic force acts diminishes with movement of the valve, as a result of which the attractive force increases. Accordingly, acceleration immediately after the start of movement is low. On the other hand, in the apparatus of the present invention, the acceleration is high immediately after the valve begins moving, as described above.

The area defined between the profile curve and the horizontal axis indicates the degree of valve opening. It will be understood that this area as obtained with the apparatus of the present invention is larger than that of the prior art by the amount indicated by the shaded portions.

Accordingly, the apparatus of the present invention is such that suction/discharge resistance at the opening of a suction/discharge valve is smaller than in the prior-art apparatus, and the performance of the engine 6 is improved over the prior-art apparatus.

Besides the table giving the correlation between the set times and engine rpm mentioned above, a map giving the correlation between engine rpm and valve opening timing can be stored in the ROM 52 in advance, and engine output and efficiency can be improved over the entire region of engine rpm by altering the valve opening timing as the rotational speed of the engine 6 changes.

In addition, it is possible to perform cylinder control to increase or decrease the number of operating cylinders by driving or stopping the suction/exhaust valves of each cylinder attendant upon a rise or fall in the rpm of the engine 6.

Though the present invention has been described primarily with regard to a suction valve, it is obvious that the drive apparatus according to the invention can be similarly applied to an exhaust valve.

As many apparently widely different embodiments of the present invention can be made without departing from the spirit and scope thereof, it is to be understood that the invention is not limited to the specific embodiments thereof except as defined in the appended claims.

What is claimed is:

1. An electromagnetic force valve driving apparatus for opening and closing a suction/exhaust valve of an engine, comprising:

a freely reciprocatable movable magnetic pole member connected to the suction/exhaust valve;

a upper fixed magnetic pole opposing he one end of said movable magnetic pole member;

a first electromagnet comprising a yoke member magnetically communicating with said upper fixed magnetic pole and having a lower magnetic pole opposing the other end of said movable magnetic pole member;

a second electromagnet having a first magnetic pole opposing said upper fixed magnetic pole and a second magnetic pole opposing the one end of said movable magnetic pole member;

a spring for subjecting said movable magnetic pole member to a force which moves said movable magnetic pole member in the direction of the one end thereof; and energizing control means for energizing said first and second electromagnets when the suction/exhaust valve is released and immediately before it is seated, thereby causing a repulsive force to act between the one end of said movable magnetic pole member and said second magnetic pole.

2. The apparatus according to claim 1, wherein said energizing control means energizes said first and second electromagnets immediately before the suction/exhaust valve closes, thereby causing a repulsive force to act between the one end of said movable magnetic pole member and said second magnetic pole.

3. The apparatus according to claim 1, wherein a time at which said first and second electromagnets are energized by said energizing control means is changed inconformity with rotational speed of said engine.

4. The apparatus according to claim 1, wherein timing for starting energization by said energizing control means when the suction/exhaust valve is released is changed inconformity with rotational speed of said engine.

5. The apparatus according to claim 1, wherein the suction/exhaust valve consists of a ceramic.

* * * * *

UNITED STATES PATENT AND TRADEMARK OFFICE

CERTIFICATE OF CORRECTION

PATENT NO. : 5,009,389,

DATED : April 23, 1991

INVENTOR(S) : HIDEO KAWAMURA

It is certified that error appears in the above-identified patent and that said Letters Patent is hereby corrected as shown below:

Title page, under "U.S. PATENT DOCUMENTS" insert --4,392,632 07/12/83 Gast et al.--;

Front page, under the "U.S. PATENT DOCUMENTS" category insert a category entitled --FOREIGN PATENT DOCUMENTS-- and insert therein --EP-A-281192 EPC MAGNAVOX--, and another category entitled --OTHER DOCUMENTS-- and insert therein --Automotive Engineering, Vol. 96, No. 12, 12/88, Warrendale U.S., pp. 59-64, CERAMICS IN INTERNAL COMBUSTION ENGINES--.

In the Abstract, line 1, change "An" to --A--;

Col. 3, line 38, after "31" insert --,--;

line 48, after "member" insert --3--;

UNITED STATES PATENT AND TRADEMARK OFFICE

CERTIFICATE OF CORRECTION

PATENT NO. : 5,009,389

DATED : April 23, 1991

INVENTOR(S) : HIFEO KAWAMURA

It is certified that error appears in the above-identified patent and that said Letters Patent is hereby corrected as shown below:

Col. 6, line 12, change "he" to --the--;

Signed and Sealed this

Eighth Day of September, 1992

*Attest:*

DOUGLAS B. COMER

*Attesting Officer*

*Acting Commissioner of Patents and Trademarks*